United States Patent [19]

Penird et al.

[11] 4,327,307

[45] Apr. 27, 1982

[54] SHADOW MASK FOR COLOR CATHODE RAY TUBE

[75] Inventors: Carl W. Penird, Waterloo; Peter G. Puhak, Seneca Falls, both of N.Y.

[73] Assignee: North American Philips Consumer Electronics Corp., New York, N.Y.

[21] Appl. No.: 21,744

[22] Filed: Mar. 19, 1979

[51] Int. Cl.[3] ..... H01J 29/07

[52] U.S. Cl. ..... 313/407

[58] Field of Search ..... 313/407, 405, 406, 404, 313/402

[56] References Cited

U.S. PATENT DOCUMENTS 3,479,546 11/1969 Mears ..... 313/404
3,585,431 6/1971 Long ..... 313/407
3,772,555 11/1973 McKee et al. ..... 313/404
3,808,493 4/1974 Kawamura et al. ..... 313/404

*Primary Examiner*—Palmer C. Demeo
*Attorney, Agent, or Firm*—Thomas A. Briody; Jack Oisher; John C. Fox

[57] ABSTRACT

A shadow mask for color cathode ray tubes has increased resistance to doming caused by heat generated within the tube during operation.

A plurality of spaced protuberances formed on the mask frame provide the welding locations for the mask itself and thus provide a space between the frame wall and the mask wall. This reduces the stresses normally introduced into the mask when it is welded to the frame and reduces the tendency to dome during heating.

3 Claims, 6 Drawing Figures

SHADOW MASK FOR COLOR CATHODE RAY TUBE

TECHNICAL FIELD

This invention relates to shadow masks for color cathode ray tubes and more particularly to such masks having increased resistance to doming caused by heat generated within the mask by impinging electron beams.

BACKGROUND ART

The doming of a shadow mask in color cathode ray tube is caused by thermal expansion of the mask due to the heat generated by the impinging electron beams. Since the mask comprises a fragile foraminated member attached at its peripheral edge to a relatively heavy frame, the fragile portion expands more rapidly than the frame, causing the fragile portion to expand outwardly toward the phosphor screen, a condition called "doming". This doming effects the critical alignment between the apertures in the mask and the discrete phosphor areas of the screen with which they are aligned, causing mis-registration of the beams and color dilution.

The art has long been aware of this condition, and many solutions have been proposed. Among the most successful have been bi-metallic mounting means for the mask-frame assembly such as those shown in U.S. Pat. Nos. 3,524,973; 3,524,974; and 3,803,436.

DISCLOSURE OF INVENTION

This invention provides a shadow mask having increased resistance to doming. The mask comprises a relatively rigid, substantially rectangular frame having a sidewall provided with a plurality of spaced protuberances thereon, and a relatively fragile, foraminated, curved portion which has a surrounding peripheral wall formed to telescope over the sidewall of the frame. The wall of the fragile portion is attached to the sidewall, as by welding, at only those points where there are protuberances. This assembly greatly relieves the strain normally applied to the foraminated portion if it were to be welded to a sidewall without the protuberances.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
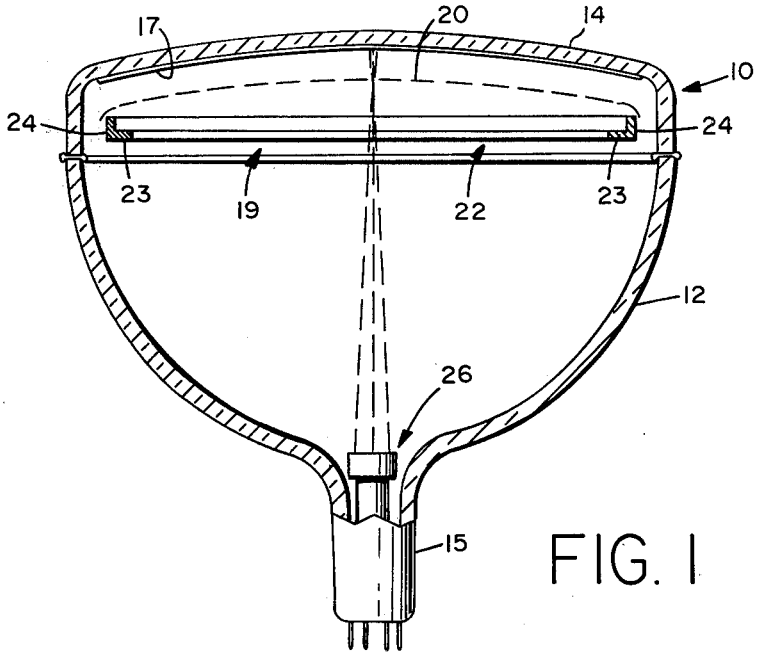
FIG. 1 is a diagrammatic, sectional view of a cathode ray tube.

Referring now to the drawings with greater particularity, in FIG. 1 there is shown diagrammatically a typical color cathode ray tube 10 comprising a substantially infundibular portion 12, face plate 14 and a neck 15. The interior surface of face plate 14 has formed thereon a mosaic cathodoluminescent screen 17. A shadow mask assembly 19 comprised of a relatively fragile, foraminated curved portion 20 and a relatively rigid frame 22 having an inwardly extending planar haze shield or flange 23 at the upper surface thereof and a peripheral wall 24 projecting therefrom is positioned adjacent to the screen. An electron source 26, which is typically a package of three electron guns is positioned within neck 15.

Figure 2:
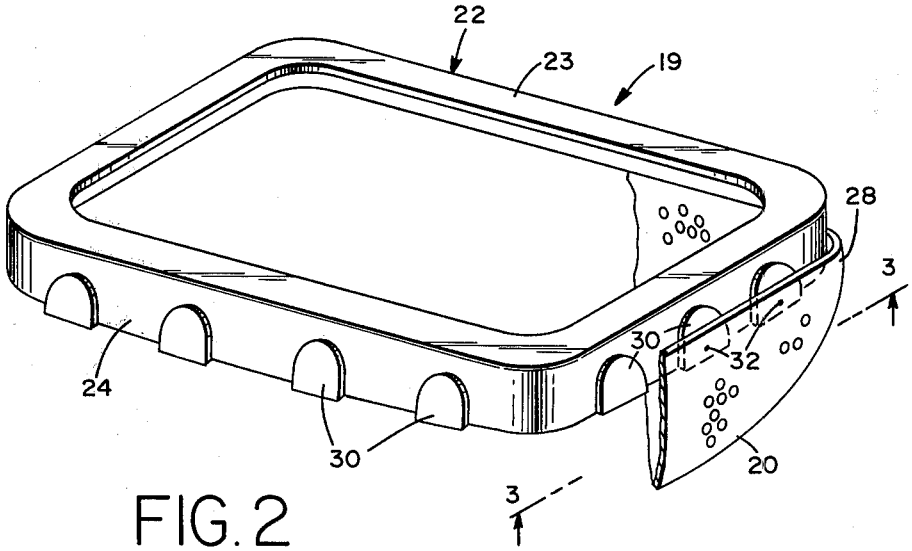
FIG. 2 is a perspective of one embodiment of the invention.

Referring now to FIG. 2 there is shown in detail a shadow mask assembly 19 having the above-described frame 22 with flange 23 and attached sidewall 24. Attached to sidewall 24 by means of a telescoping solid skirt 28 is the curved, foraminated portion 20. Actual attachment occurs only between points on the skirt 28 and a protuberance 30 formed on sidewall 24. These extending protuberances 30 space part of the solid skirt 28 away from sections of sidewall 24 and thus relieve tension in the foraminated portion 20. Attachment is by means of welds 32.

Figure 3:
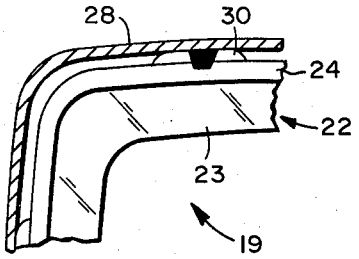
FIG. 3 is a partial view, taken generally along the line 3—3 of FIG. 2, showing an embodiment of the invention.
Figure 4:
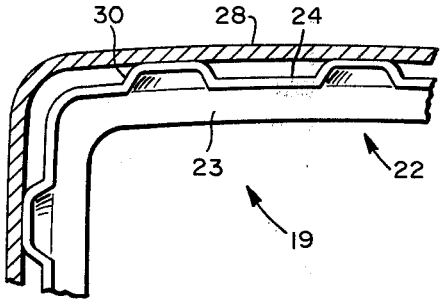
FIG. 4 is a view similar to FIG. 3 showing an alternate embodiment of the invention.

Protuberances 30 can be fashioned in a number of ways. Thus, they can be formed from an additional thickness of material welded to sidewall 24, as is shown in FIG. 3. Also, protuberances 30 can be formed or extruded directly into side wall 24, such as is shown in FIG. 4.

Figure 6:
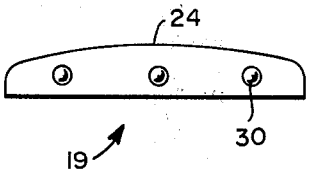
FIG. 6 is a side elevational view of a shadow mask frame illustrating yet another embodiment of the invention.
Figure 5:
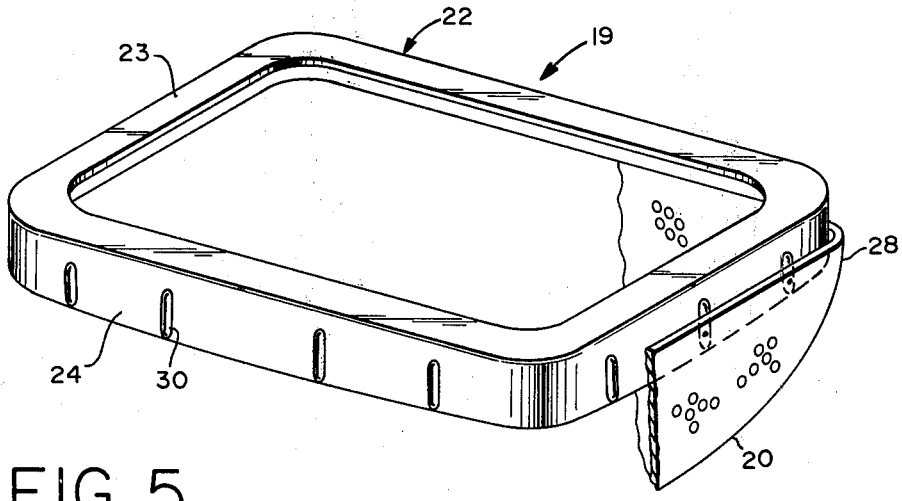
FIG. 5 is a perspective view of a shadow mask illustrating another embodiment of the invention.

Different shapes are also possible. In FIG. 5, protuberances 30 are shown as being long and narrow, while in FIG. 6 they are circular. In the embodiments of FIGS. 2, 3 and 4 the protuberances 30 have a height and width substantially equal.

This spacing technique for the thin portion of the shadow mask greatly reduces the effect of doming and can be employed with or without the additional correction afforded by the use of bi-metallic elements to support the shadow mask assembly within the tube 10.

While there has been shown and described what are at present considered the preferred embodiments of the invention it will be obvious to those skilled in the art that various changes and modifications may be made therein without departing from the invention as defined by the appended claims.

We claim:

1. A shadow mask for a color cathode ray tube, said shadow mask having increased tolerance to doming caused by heat generated by impingement of an electron beam and comprising: a relatively rigid light weight frame of substantially rectangular configuration being formed to provide an inwardly extending flange having an attached sidewall thereabout and a relatively fragile portion having a curved foraminated face and a solid skirt surrounding said face, a portion of said skirt being formed to provide a substantially rectangular, peripheral, upstanding wall having four sides extending from said face and which upstanding wall telescopes over said sidewall, the improvement comprising: a plurality of spaced projections formed in said frame sidewall, said projections being incapable of movement independent of said frame sidewall and being extruded therefrom, and said fragile portion being attached to said frame by means of welds only between said upstanding wall and said projectons.

2. The shadow mask of claim 1 wherein said extruded projections have a height greater than their width.

3. The shadow mask of claim 1 wherein said extruded projections have their height and width substantially equal.

* * * * *